US009163520B2

(12) United States Patent
Chauveau et al.

(10) Patent No.: US 9,163,520 B2
(45) Date of Patent: Oct. 20, 2015

(54) TURBINE WHEEL FITTED WITH AN AXIAL RETAINING RING THAT LOCKS THE BLADES RELATIVE TO A DISK

(75) Inventors: Damien Chauveau, Pau (FR); Jean-Luc Sahores, Mazeres-Lezons (FR)

(73) Assignee: TURBOMECA, Bordes (FR)

( * ) Notice: Subject to any disclaimer, the term of this patent is extended or adjusted under 35 U.S.C. 154(b) by 793 days.

(21) Appl. No.: 13/501,884

(22) PCT Filed: Oct. 12, 2010

(86) PCT No.: PCT/FR2010/052151

§ 371 (c)(1),
(2), (4) Date: Apr. 13, 2012

(87) PCT Pub. No.: WO2011/045520

PCT Pub. Date: Apr. 21, 2011

(65) Prior Publication Data

US 2012/0201681 A1 Aug. 9, 2012

(30) Foreign Application Priority Data

Oct. 13, 2009 (FR) ..... 09 57150

(51) Int. Cl.
*F01D 5/03* (2006.01)
*F01D 5/30* (2006.01)
*F01D 5/32* (2006.01)

(52) U.S. Cl.
CPC ..... *F01D 5/3015* (2013.01); *F01D 5/326* (2013.01); *F05D 2260/30* (2013.01)

(58) Field of Classification Search
CPC .... F01D 5/3015; F01D 5/326; F05D 2260/30
USPC ..... 416/220 R, 221, 220 A
See application file for complete search history.

(56) References Cited

U.S. PATENT DOCUMENTS

| | | | | |
|---|---|---|---|---|
| 4,221,542 | A | 9/1980 | Acres et al. | |
| 5,330,324 | A * | 7/1994 | Agram et al. | 416/220 R |
| 5,622,476 | A * | 4/1997 | Adde et al. | 416/221 |
| 6,234,756 | B1 | 5/2001 | Ress, Jr. et al. | |

(Continued)

FOREIGN PATENT DOCUMENTS

| | | |
|---|---|---|
| EP | 1 443 179 | 8/2004 |
| EP | 1 760 258 | 3/2007 |

(Continued)

OTHER PUBLICATIONS

International Search Report issued on Feb. 24, 2011 in PCT/FR10/052151 filed on Oct. 12, 2010.

*Primary Examiner* — Edward Look
*Assistant Examiner* — Jesse Prager
(74) *Attorney, Agent, or Firm* — Oblon, McClelland, Maier & Neustadt, L.L.P.

(57) ABSTRACT

A turbine wheel having an axis of rotation and including: a disk having a periphery and a side face; a plurality of blades assembled on the disk, each blade having a blade root and a first hook oriented radially and defining a first groove that opens radially towards the axis of rotation of the turbine wheel. The disk includes a series of second hooks oriented radially and defining a second groove that opens radially towards the axis of rotation of the turbine wheel. An axial retaining ring for placing in the first and second grooves includes a tab for placing between two adjacent blade roots to limit movements of the ring in azimuth.

12 Claims, 3 Drawing Sheets

(56) References Cited

U.S. PATENT DOCUMENTS

| | | | |
|---|---|---|---|
| 2004/0151591 | A1 | 8/2004 | Udell et al. |
| 2007/0048141 | A1 | 3/2007 | Boston et al. |

FOREIGN PATENT DOCUMENTS

| | | |
|---|---|---|
| FR | 2 729 709 | 7/1996 |
| GB | 2011 551 | 7/1979 |

* cited by examiner

TURBINE WHEEL FITTED WITH AN AXIAL RETAINING RING THAT LOCKS THE BLADES RELATIVE TO A DISK

BACKGROUND OF THE INVENTION

1. Field of the Invention

The invention relates in general to bladed wheels in gas turbines, and it relates more particularly to axially retaining said blades relative to the axis of the wheel.

A particular field of application of the invention is that of aircraft gas turbines, and also that of industrial gas turbines.

1. Description of the Related Art

A conventional turbine wheel presents an axis of rotation and comprises: a disk having a periphery and a side face; a plurality of blades assembled on the disk, each blade having a blade root and a first hook projecting axially therefrom, said first hook being oriented radially and defining a first groove that opens radially towards the axis of rotation of the turbine wheel; the disk including a series of second hooks projecting axially from its side face on the same side as the first hooks, each second hook being oriented radially and defining a second groove that opens radially towards the axis of rotation of the turbine wheel; and an axial retaining ring including at least one tab and designed to be arranged in the first groove and in the second groove in order to retain the blades axially relative to the disk.

Among known turbine wheels, e.g. as disclosed in patent FR 2 729 709, the ring has a tab that is prevented from turning between different portions of the turbine wheel so as to make safe the assembly of the ring and the retention of the blades on the disk.

BRIEF SUMMARY OF THE INVENTION

An object of the invention is to propose an alternative to known structures for assembling turbine wheels.

This object is achieved by the fact that in the above-mentioned type of turbine wheel, the tab is designed to be placed between two adjacent blade roots in such a manner as to limit movements of the ring in azimuth.

The term "root" is used to mean that part of the blade located at the base of the blade for assembling the blade on the disk. It should be observed below that the term "wheel" and the term "turbine wheel" are both used interchangeably to designate the same item. It can thus be understood that in the assembled position, movement of the tab in azimuth is restrained by two adjacent blade roots. In order to do this, the tab may come into abutment against one or the other of the two blade roots. Consequently, movement of the ring in azimuth is limited.

The tab is arranged in a space that extends between two adjacent blade roots in such a manner that no particular machining is needed, in particular for providing a space for receiving the tab. It is thus possible to assemble on the wheel a set of blades that have roots that are identical. In addition, the blades may all be identical, thereby facilitating assembly of the wheel. An operator has no need to pay special attention to placing a blade having a special root relative to the tab.

Thus, the movement of the ring in azimuth is at most equal to the length in azimuth of the space available between two adjacent roots minus the length in azimuth of the tab. When the tab extends over the major fraction of the available length in azimuth, it is advantageous to make provision for the ring to be able to have non-zero maximum movements in azimuth, in particular to facilitate assembly and to accommodate differential thermal expansion. It should be observed that the first grooves are defined between the first hooks and the blade roots, while the second grooves are defined between the second hooks and the disk. The ring moves in azimuth in the first and second grooves.

Furthermore, it should be observed that the arrangement of the tab between two blade roots advantageously makes it possible to avoid any particular machining of said tab, in particular for the purpose of enabling it to be inserted between two blade roots. Furthermore, this arrangement between two blade roots makes it possible to place the tab between any pair of blade roots. Thus, there is no preferred azimuth position for the tab relative to the disk or relative to the blade roots. Consequently, it is possible for the ring to be assembled in a plurality of azimuth positions, thus making the ring versatile. Thus, unlike prior art devices, the turbine wheel of the present invention is not limited to assembling the tab and thus the ring in a single position relative to the turbine wheel.

Advantageously, the tab projects axially from an axial face of the ring.

The term "axial face" of the ring is used to mean a face of the ring that is perpendicular to the axis of rotation of the turbine. In other words, an axial face of the ring is a face that is substantially parallel to the side face of the disk. In the assembled position, the tab preferably projects in an axial direction away from the side face of the disk.

Advantageously, the tab is placed on an inner annular portion of the ring.

Considering the ring as having an inner peripheral edge and an outer peripheral edge together with an intermediate geometrical line extending parallel between the inner and outer peripheral edges, the inner annular portion of the ring is considered as being a portion of the ring defined by the inner peripheral edge and the intermediate line of the ring, while an outer peripheral portion of the ring is considered as being a portion of the ring defined by the outer peripheral edge and the intermediate line of the ring. It can thus be understood that the tab extends radially from an axial face of the ring, between the inner peripheral edge and the intermediate line of the ring.

Preferably, the tab is designed to be placed between the first hooks of two adjacent blade roots.

Thus, the tab is suitable for co-operating with said first hooks of the blade roots in order to limit the movement of the ring in azimuth. It can thus be understood that the azimuth space in which the tab extends is defined in azimuth by the first hooks. Thus, the first hooks present abutment zones for the tab.

Advantageously, the tab is designed to be placed radially in register with one of the second hooks.

It can thus be understood that one of the second hooks is arranged in the space in azimuth that is available between two adjacent blade roots. This second hook and the tab are arranged on substantially the same radius of the wheel. The second hook is radially further away from the axis of rotation of the wheel than is the tab. The second hook is thus oriented towards the tab.

Preferably, the minimum distance between the tab and the outer peripheral edge of the ring is greater than the depth of one of the second grooves.

Thus, if the tab is in register with a second hook, it is certain that the outer edge of the ring is suitable for coming into contact with the bottom of the second groove, e.g. under the effect of centrifugal forces while the turbine wheel is rotating, but without the tab running any risk of co-operating with the second hook. This avoids radial mechanical stresses on the tab, where such stresses do not serve to limit movement of the ring in azimuth. This improves the lifetime of the ring. Furthermore, mechanical stresses in bending are also limited in the second hook that is located in register with the tab, by avoiding any contact between the tab and a second hook. As a result, ring co-operation is identical in each of the second grooves of the disk independently of the presence of the tab.

Advantageously, the first hook of each blade projects radially from the root of said blade.

This structure for the first hook makes it easy to fabricate first hooks having their first grooves arranged in continuity in azimuth with the second grooves of the disk. Thus, when the blades are assembled on the disk, the first hooks project axially from the plane defined by the side face of the disk.

Preferably, the root of each blade is engaged in a housing that opens out into the periphery of the disk, the housings being separated by teeth, with each second hook projecting from one of the teeth.

At the periphery of the disk, it can be understood that the teeth alternate with the blade roots, and that the first hooks alternate with the second hooks. Thus, the circumferential groove receiving the ring is constituted by an alternating succession of first and second grooves. It should be observed that the circumferential groove is not necessarily continuous and may present gaps between the first and second grooves. Such a groove structure enables the blade retaining forces to be distributed uniformly over the entire periphery of the disk. This also makes it possible to hold the ring better and thus avoid dynamic effects that are harmful to the structure, such as vibration.

Advantageously, the tab presents contact faces suitable for making plane-on-plane contact with bearing faces of two roots of blades that limit movement of the ring in azimuth.

By providing contact faces on the tab and bearing faces on the roots, an interface is created between the tab and the roots, thereby improving co-operation therebetween. Thus, when the tab co-operates with a root, the tab finds it difficult to slide and disengage from the blocking in azimuth provided by the root.

Preferably, the ring presents a slot diametrically opposite from the tab.

The slot in the ring serves to facilitate assembling the ring in the first and second grooves. The position of the slot diametrically opposite from the tab serves to improve the functional reliability of the ring. If the ring should break, the break will very probably be situated in the vicinity of the tab. The broken ring would then form two half-rings of substantially equivalent length that cannot become disengaged from the first and second hooks. Thus, having only one tab that is arranged opposite from the slot, it is possible to concentrate the mechanical stresses to which the ring is subjected into the vicinity of said tab opposite from the slot, and consequently to improve the functional reliability of the ring. Furthermore, since the slot is located diametrically opposite from the tab, the ring is placed in the first and second grooves by making use of the radial flexibility of the ring and by placing the tab between two blade roots from the very start. Thus, once assembled, movements of the ring in azimuth are limited.

Advantageously, the ring presents the general shape of an annulus having an axis, with the center of gravity of said ring being situated on said axis.

A balanced ring presents the advantage of not influencing the balance of the entire rotary assembly constituted by the disk and the blade. Thus, there is no need to provide for special machining of the turbine wheel in order to compensate for unbalance due to a non-uniform distribution of masses. Consequently, it is possible to assemble the ring in any potential position in azimuth without disturbing the uniform distribution of masses in azimuth, thereby making the turbine wheel easier to assemble.

The present invention also provides a turbine engine including a turbine wheel of the invention.

BRIEF DESCRIPTION OF THE SEVERAL VIEWS OF THE DRAWINGS

The invention and its advantages can be better understood on reading the following detailed description of an embodiment given by way of non-limiting example. The description refers to the accompanying figures, in which.

DETAILED DESCRIPTION OF THE INVENTION

Figure 1:
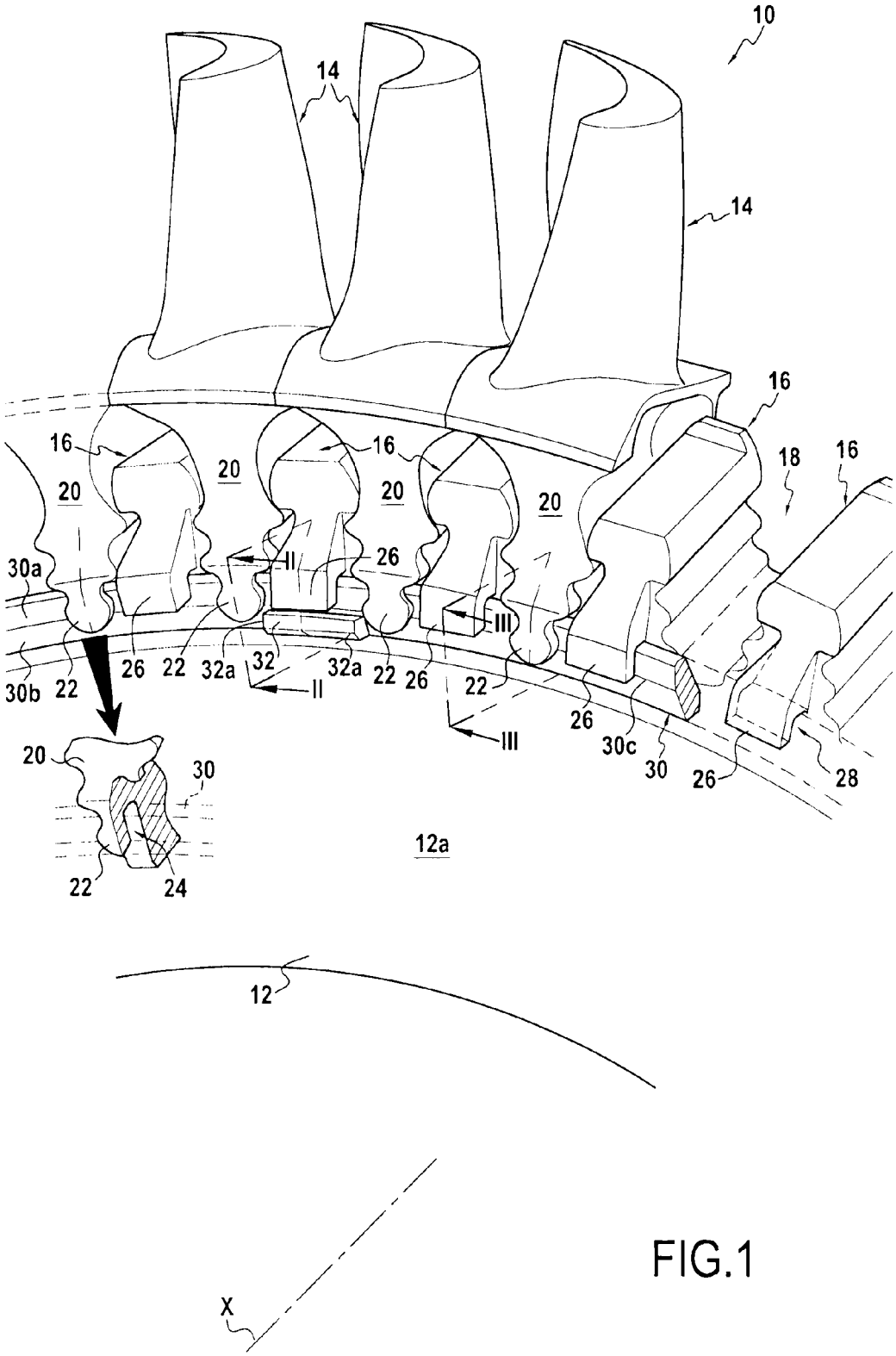
FIG. 1 shows a portion of a turbine wheel of the invention.

FIG. 1 shows a portion of a turbine wheel 10 having an axis of rotation X. The turbine wheel 10 comprises a disk 12 and a plurality of blades 14. At its periphery, the disk 12 presents a plurality of teeth 16 that are spaced apart by housings 18. Each blade 14 of the turbine wheel 10 is engaged in a housing 18 via its root 20. Each root 20 of a blade 14 presents a first hook 22 that projects axially (along the axis X). On each blade 14, the first hook 22 is oriented radially and forms a first groove 24 that opens radially towards the axis of rotation X of the wheel 10. The term "oriented radially" means that it is "oriented along a radius of the turbine wheel", whereas the term "oriented axially" means that it is "oriented along the axis of rotation of the turbine".

Each tooth 16 of the disk 12 presents a second hook 26 that projects axially (along the axis X). On each tooth 16, the second hook 26 is oriented radially and defines a second groove 28. The first and second hooks 22 and 26 extend axially from the plane defined by the side face 12*a* of the disk 12, and on the same side. The first grooves 24 and the second grooves 28 are in alignment in azimuth. In the azimuth direction, the first hook 22 alternates with the second hooks 26. The term "azimuth direction" is used to mean "oriented along the circumference of the turbine wheel".

In this example, the first hook 22 is situated at the attachment base of the blade and the second hooks 26 at the bases of the teeth 16. In a variant, the first hook 22 could be placed on some other portion of the root, e.g. under the platform of the blade 14. The second hook 26 would then be placed level with the tips of the teeth 16. In other words, the hooks may occupy a variety of radial positions.

In order to retain the blades 14 axially on the disk 12, a retaining ring 30 is placed in the first groove 24 and in the second groove 28. This retaining ring 30 is annular in shape about an axis that coincides with the axis of rotation X of the turbine. The retaining ring 30 presents a single tab 32 placed on an axial face of the ring 30, facing away from the side face 12*a* of the disk 12. The tab 32 is arranged between two adjacent roots 20 of two adjacent blades 14. The azimuth ends 32*a* of the tab 32 are suitable for coming into abutment against the roots 20 on either side thereof, and more particularly with the first hooks 22, so as to limit the axial movement of the retaining ring 30 in the first and second grooves 24 and 28.

The tab 32 is also arranged vertically in register with a second hook 26. Whatever the mechanical conditions to which the ring 30 is subjected, the tab 32 never comes into contact with the second hook 26, neither radially, nor in azimuth. Thus, the first hooks 22 are radially longer than the second hooks 26 so that the first hooks 22 are suitable for co-operating with the tab 32 while the second hooks 26 leave the tab 32 (and thus the ring 30) free to move in azimuth. Consequently, the first grooves 24 defined by the first hooks 22 are deeper than the second grooves 28 defined by the second hooks 26.

In order to ensure that the tab 32 cannot come into contact with the second hooks 26 and in order to ensure that the ring 30 is engaged in the second grooves 28, the ring 30 presents an outer annular portion 30*a* from which the tab 32 does not extend. Thus, the tab 32 occupies an inner annular portion 30*b* of the ring 30. In this example, the inner annular portion 30*b* is defined by and separated from the outer annular portion 30*a* by means of an intermediate line 30*c* in the axial face supporting the tab 32. This intermediate line 30*c* is a mark obtained by machining a chamfer 31*a* that is formed on the inner peripheral edge 30*d* of the axial face supporting the tab 32 (cf. FIGS. 2 and 4).

Figure 2:
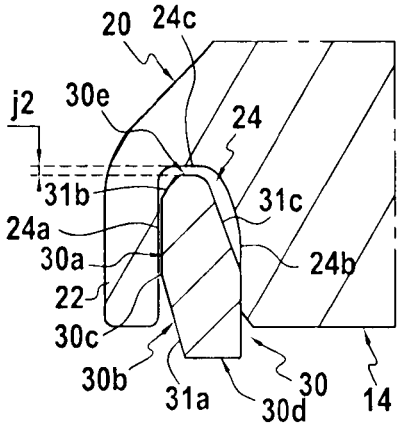
FIG. 2 shows how the retaining ring of the turbine wheel of the invention is assembled when seen in section plane II of FIG. 1.
Figure 3:
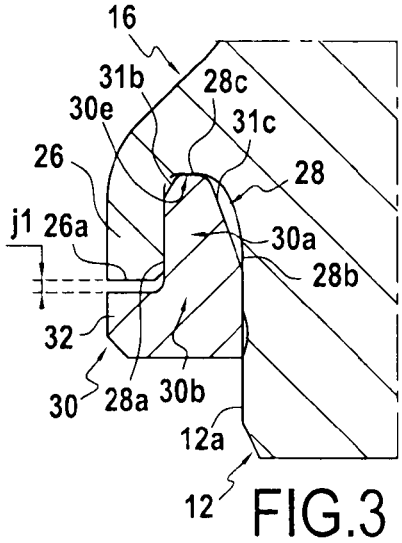
FIG. 3 shows how the retaining ring of the turbine wheel of the invention is assembled when seen in section plane II of FIG. 1.

FIG. 2 shows the ring 30 engaged in a first groove 24, seen in section plane II of FIG. 1. FIG. 3 shows the ring 30 engaged in a second groove 28, seen in section plane III of FIG. 1. The depth of the second groove 28 is less than the distance between the outer peripheral edge 30*e* of the ring 30 and the tab 32, such that the outer peripheral edge 30*e* of the ring 30 co-operates with the bottom 28*c* of the second groove 28, while the tab 32 is radially spaced apart from the edge 26*a* of the second hook 26 with some minimum clearance j1, as can be seen in FIG. 3. In other words, the clearance j1 is greater than the radial deformation of the ring 30 at the tab 32 when the turbine wheel 10 is in operation.

Furthermore, the bottoms 24*c* of the first grooves 24 are radially further from the axis of rotation X of the turbine wheel 10 than are the bottoms 28*c* of the second grooves 28, such that the outer peripheral edge 30*e* of the ring 30 remains spaced apart from the bottoms 24*c* of the first grooves 24 by some minimum clearance j2, while it co-operates with the bottoms 28*c* of the second grooves 28. In other words, the clearance j2 is greater than the radial deformation of the ring 30 between two first and second hooks 22 and 26. The ring 30 is thus held radially solely by the second hooks 26, while it co-operates in the axial direction with both the first and the second hooks 22 and 26. The ring 30 also co-operates with the side face 12*a* of the disk 12. In other words, the ring 30 co-operates radially solely with the bottoms 28*c* of the second grooves 28, while it co-operates radially with the side faces 24*a* and 24*b* of the first grooves 24, with the side faces 28*a* and 28*b* of the second grooves 28, and with the side face 12*a* of the disk 12. The ring 30 thus co-operates radially solely with the second hooks 26. This presents the advantage of limiting the contact wear to which the first hooks 22 are subjected, in particular in the bottoms of the first grooves 24. This assembly thus eliminates any risk of the first hooks 22 of the blades 14 breaking.

It should be observed that in its outer periphery 30*e*, the ring 30 presents chamfers 31*b* and 31*c* on its axial faces in order to make it easier to insert into the first and second grooves 24 and 28. The width of the chamfer 31*b* formed on the axial face supporting the tab 32 is less than the width of the chamfer 31*c* formed on the axial face facing the side face 12*a* of the disk 12. The term "width" is used of a chamfer to mean the dimension of the chamfer that extends radially over the chamfered portion of the ring.

Figure 4:
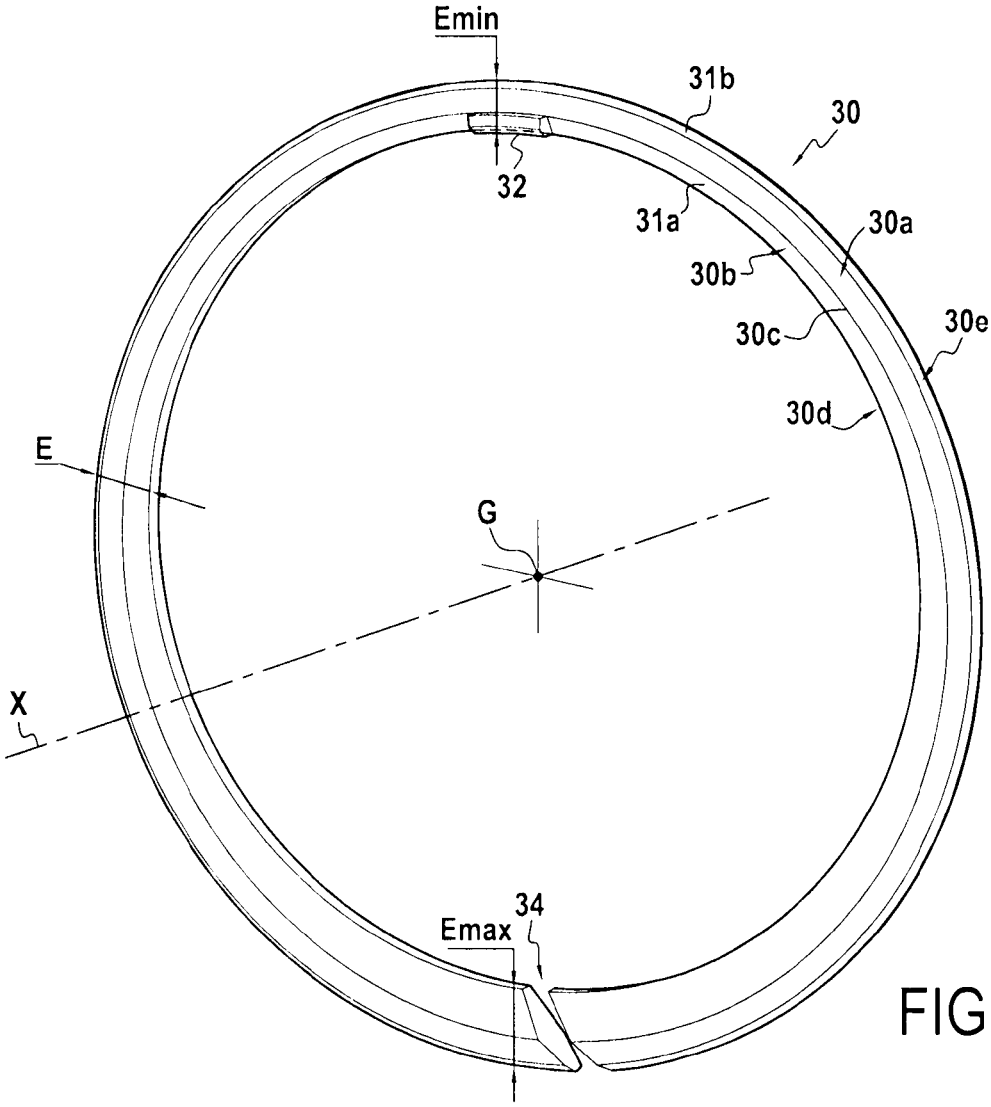
FIG. 4 shows the FIG. 1 retaining ring as a whole.

FIG. 4 shows the retaining ring 30 in perspective. The ring 30 presents a slot 34 diametrically opposite the tab 32. The slot 34 is angled, i.e. it extends obliquely relative to a radius of the ring 30. This angled slot 34 makes it easy to flex the ring 30 radially in order to insert it in the first and second grooves 24 and 28. In particular, the angled shape of the slot 34 makes it possible to avoid interaction between the ends of the ring 30 that define the edges of the slot 34, where such interaction might block and limit elastic deformation of the ring 30 during assembly. It should be observed that when the wheel 10 is not in operation, the ring 30 is held in the first and second grooves 24 and 28 by its natural elasticity, whereas when the turbine wheel 10 is in operation, the ring 30 is also held in the first and second grooves 24 and 28 by centrifugal forces.

When the ring 30 is assembled on the turbine wheel 10, the slot 34 is preferably located in a first or a second groove 24 or 28 so that a first or a second hook 22 or 26 limits and/or prevents axial movements of the ends of the ring 30 that define the slot 34. Preferably, when the ring is assembled on the turbine wheel 10, the slot is located in one of the second grooves 28 under one of the second hooks 26. Advantageously, the length in azimuth of the tab 32 is such that the maximum authorized movements in azimuth of the ring leave the slot 34 engaged in a first or a second groove 24 or 28. In other words, the azimuth length of the tab 32 is such that the slot 34 does not disengage from a first or a second groove 24 or 28, even when the tab 32 is in abutment against one of the roots 20 on either side thereof.

In order to ensure that the ring 30 is balanced, i.e. in order to ensure that its center of gravity G is situated on the axis of the ring 30, which axis coincides with the axis of rotation X of the turbine wheel 10, the radial thickness E of the ring 30 varies around the circumference of the ring 30. In order to compensate for the extra material represented by the tab 32 and the lack of material represented by the slot 34, the radial thickness E of the ring 30 varies continuously and progressively between a minimum radial thickness Emin at the tab 32 and a maximum radial thickness Emax at the slot 34. The variation in radial thickness E takes place essentially in the inner annular portion 30*b* of the ring 30. Thus, the center of gravity G of the ring 30 lies on the axis of the ring 30, preferably at the intersection with the midplane of the ring 30. The term "midplane" is used for the ring to mean the plane that passes halfway through the axial thickness of the ring 30. Naturally, in a variant, the ring may be balanced in azimuth by adjusting the shape of the chamfers 31*a*, 31*b*, and 31*c*. Naturally, both adjustments (chamfer and radial thickness) could also be used in combination. Furthermore, it is also possible to adjust the balance of the ring by off-center machining of the tab 32. Since there is only one tab, this adjustment by machining can thus be performed easily and quickly. In addition, the tab 32 does not present a preferred position in azimuth within the wheel 10, so it is possible to perform so-called "thirding" operations that consist in selecting a position in azimuth for the tab 32 so as to improve the overall balance of the wheel 10.

Figure 5:
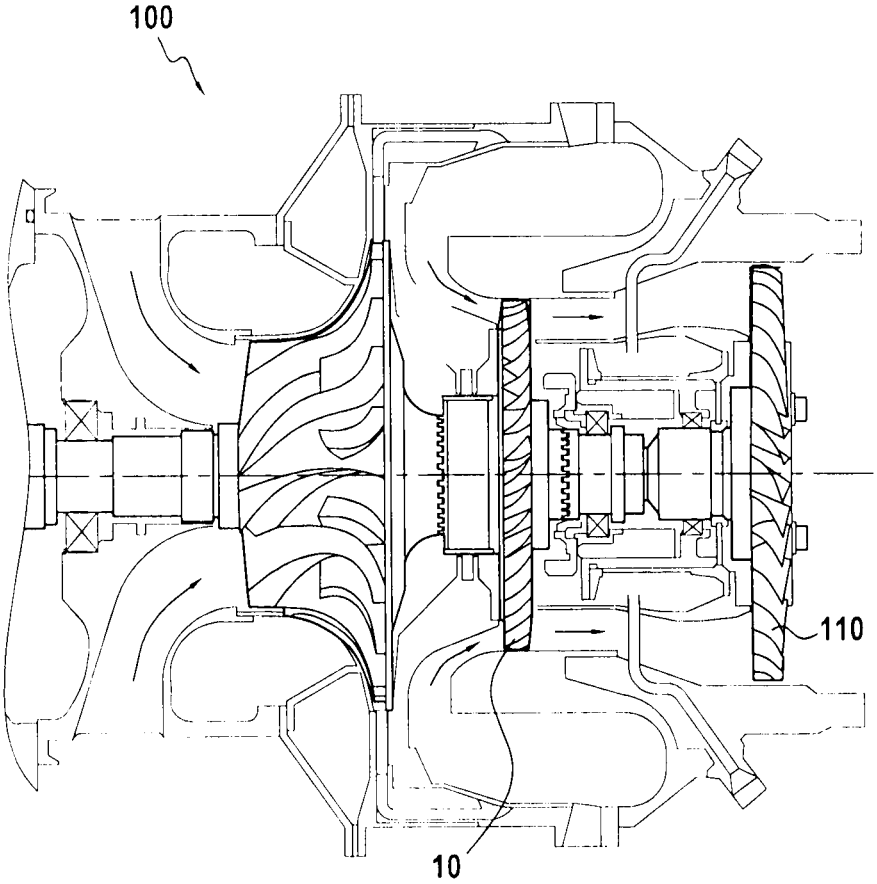
FIG. 5 shows a helicopter turbine engine fitted with a turbine wheel of the invention.

FIG. 5 shows a helicopter turbine engine 100 fitted with the turbine wheel 10. Naturally, a second turbine wheel 110 may advantageously be made in accordance with the invention, but that is not essential.

The invention claimed is:

1. A turbine wheel having an axis of rotation and comprising:

a disk having a periphery and a side face;

a plurality of blades assembled on the disk, each blade including a root of the blade and a first hook projecting axially therefrom, the first hook being oriented radially and defining a first groove that opens radially towards the axis of rotation of the turbine wheel;

the disk including a series of second hooks projecting axially from its side face on a same side as the first hooks, each second hook being oriented radially and defining a second groove that opens radially towards the axis of rotation of the turbine wheel; and an axial retaining ring including at least one tab and configured to be arranged in the first groove and in the second groove to retain the blades axially relative to the disk, the ring presenting an outer annular portion from which the tab does not extend, and the tab occupying an inner annular portion of the ring, wherein the tab is configured to be arranged between two roots of adjacent blades so as to limit movements of the ring in azimuth, wherein a depth of the second groove is less than a distance between the outer peripheral edge of the of the ring and the tab such that the outer peripheral edge of the ring cooperates with a bottom of the second groove and the tab is radially spaced apart from a free edge of the second hook with a first minimum clearance, the first minimum clearance being greater than a radial deformation of the ring at the tab when the turbine wheel is in operation, and wherein a bottom of the first groove is radially further from the axis of rotation than the bottom of the second groove such that the outer peripheral edge of the ring is spaced apart from the bottom of the first groove by a second minimum clearance while the outer peripheral edge of the ring cooperates with the bottom of the second groove, the second minimum clearance being greater than the radial deformation of the ring between the first and second hooks.

2. A turbine wheel according to claim 1, wherein the tab projects axially from an axial face of the ring.

3. A turbine wheel according to claim 1, wherein the tab is placed on an inner annular portion of the ring.

4. A turbine wheel according to claim 1, wherein the tab is configured to be placed between the first hooks of two adjacent roots of blade.

5. A turbine wheel according to claim 1, wherein the first hook of each blade projects radially from the root of the blade.

6. A turbine wheel according to claim 1, wherein the root of each blade is engaged in a housing that opens out into the periphery of the disk, the housings being separated by teeth, with each second hook projecting from one of the teeth.

7. A turbine wheel according to claim 1, wherein the tab presents contact faces configured to make plane-on-plane contact with bearing faces of two roots of blades that limit movement of the ring in azimuth.

8. A turbine wheel according to claim 1, wherein the ring presents a slot diametrically opposite from the tab.

9. A turbine wheel according to claim 1, wherein the ring presents a general shape of an annulus having an axis, with the center of gravity of the ring being situated on the axis.

10. A turbine wheel according to claim 1, wherein the ring cooperates radially solely with the second hooks.

11. A turbine engine including a turbine wheel according to claim 1.

12. A turbine wheel according to claim 1, wherein the outer annular portion of the ring and the inner annular portion of the ring are separated by a chamfer that is provided on an inner peripheral edge of an axial face supporting the tab.

* * * * *